United States Patent [19]

Elaschuk

[11] 4,437,700

[45] Mar. 20, 1984

[54] COLLAPSIBLE OR FOLDING CHAIR

[76] Inventor: John T. Elaschuk, 39 Geoffrey St., Toronto, Ontario, Canada, M6R 1P2

[21] Appl. No.: 284,131

[22] Filed: Jul. 16, 1981

[51] Int. Cl.[3] ..... A47C 4/28

[52] U.S. Cl. ..... 297/45

[58] Field of Search ..... 297/45, 42, 44, 441

[56] References Cited

U.S. PATENT DOCUMENTS

| | | | |
|---|---|---|---|
| 1,703,879 | 3/1929 | Goldwyn | 297/45 X |
| 1,739,552 | 12/1929 | Kidder | 297/45 X |
| 1,858,254 | 5/1932 | Uline | 297/45 |
| 3,485,528 | 12/1969 | Kramer | 297/45 |
| 3,711,151 | 1/1973 | Upton | 297/45 |
| 3,977,721 | 8/1976 | Peterson | 297/45 |

*Primary Examiner*—Francis K. Zugel

*Attorney, Agent, or Firm*—Weldon F. Green

[57] ABSTRACT

A collapsible chair that includes a front pair and rear pair of crossed, pivotally interconnected legs having a common pivot axis extending from front to rear, seat-supporting rails extending between the pairs of legs front to rear at each side with such seat-supporting rails secured to the uppermost portion of each leg and inwardly thereof, unitary armrest and backrest supporting structure extending between the pairs of legs front to rear at each side by pivots securing same to the uppermost portion of each respective leg only, so as to be swingably separable from the adjacent inner seat-supporting rail and to move into substantial upstanding abutment thereagainst in chair-defining relation, with each unitary armrest and backrest supporting structure including a reinforcing member projecting inwardly thereof moving into and out of overlying engagement with the uppermost surface of the adjacent inner seat-supporting rail.

7 Claims, 7 Drawing Figures

COLLAPSIBLE OR FOLDING CHAIR

FIELD OF INVENTION

This invention relates to improvements in collapsible or folding chairs of the type commonly described or identified as a captain's chair, a director's chair or a yachting chair, and more particularly to the manner in which the seat formation and associated armrest and backrest structures are carried and cooperate with the collapsible supporting leg structure thereof, so as to provide, when fully erect and in use, increased structural strength, stability and comfort as compared with known alternatives.

BACKGROUND OF THE INVENTION

Chairs falling within this category include a front pair and rear pair of crossed, pivotally interconnected legs, secured together by lower reinforcing cross-bars at each side and upper reinforcing seat-supporting rails at each side, the associated combined armrest and backrest structure being pivotally mounted upon the leg structure at each side and above the seat-supporting rails, the whole being adapted for swinging movement in unison from a collapsed position in side-by-side relation to a fully erect position in spaced-apart relation and reversely.

The seat element and backrest element are flexible and are adapted to extend respectively between the side or seat rails and the backrest structure, the seat and backrest elements assuming a somewhat taut condition with the seat rails and backrest structure in the spaced apart fully erect configuration, the legs preferably being provided with interlocking braces to releasably secure the legs against collapse when in chair defining relation and so stabilize the entire framework.

One example of an early chair structure of interest is that found in U.S. Pat. No. 1,739,552 wherein the upper side or seat rails are integral with the respective armrest and backrest structures and together are pivotally interconnected with the leg structure by offset or arm-like hinge members, the flexible seat element being secured by clamping strips thereto and stretched to tautness between the seat rails in chair defining relation.

Another prior alternative is the folding chair revealed by U.S. Pat. No. 2,962,085 in which metal side or seat rails have a specially extruded shape in cross-section and are fixedly secured to the opposed pairs of legs uppermost, each side or seat rail being hinged outermost throughout its entire extent to a like cooperating, rigidifying bar presented by the respective asociated armrest and backrest structure so as to securely clamp the flexible seat element against dislodgment when stretched therebetween in chair defining relation.

Still another embodiment of a collapsible chair demonstrating the trend of development in this field is that disclosed by U.S. Pat. No. 3,138,401 in which a combination metal hinge and leg bracket for each leg is provided for attaching and retaining the flexible fabric at the corners of the seat element which eliminates the need for a seat rail of substantial rigidity and strength thereby achieving a certain economy in production.

OBJECTS OF THE INVENTION

The principal object of this invention is to provide a lightweight collapsible folding chair of the aforementioned type that includes an even more simplified framework of cooperating components and elements as compared with the prior known structures identified herein or other alternatives, yet imparts increased structural strength, stability and comfort when fully erected and in use.

More particularly, it is a very important object of this invention to limit the number of required components to a minimum, to adopt the least complicated appropriate shaping for each without appreciably diminishing the strength of that component, utilizing stock items of requisite tensile and shear strength for tying or connecting the components together and limiting the number of connections to a minimum sufficient to preserve the integrity of the framework, all of which promotes greater efficiency and keeps the costs of production down.

It is also an important object to provide a collapsible chair structure whose principal load supporting members can be made or fashioned from wooden pieces and particularly from wooden pieces or lengths having standard dimensions in cross-section.

Still another very important object is to provide a framework and seat and back rest elements for a collapsible chair of the type and character indicated which will meet contemporary standards of proportion and styling.

FEATURES OF THE INVENTION

According to the invention, a collapsible chair is provided which includes a front pair and rear pair of crossed, pivotally interconnected legs having a common pivot axis extending from front to rear, a seat-supporting rail extending between the pairs of legs at each side with each such seat-supporting rail secured to the uppermost portion of each leg and inwardly thereof in substantially parallel relation for swinging movement with the legs about said pivot axis from a collapsed position in which the seat-suppporting rails are in substantial side-by-side relation to an erect position in which the seat-supporting rails are spaced apart in chair-defining relation, and reversely, with a unitary armrest and backrest supporting structure extending between the pairs of legs at each side with each such unitary supporting structure pivotally secured only to the uppermost portion of each leg upon an axis located outwardly of and below the uppermost extent of the adjacent seat-supporting rail for swinging movement upon said legs from the collapsed position wherein each unitary supporting structure is swingably separable from the seat supporting rails to the erect position wherein each unitary supporting structure is in substantial upright abutment therewith in chair-defining relation, and reversely, each unitary supporting structure including a reinforcing member projecting inwardly thereof and therealong and so spaced upwardly from its said pivot axis as to move into and out of overlying engagement with the uppermost extent of the adjacent inner seat-supporting rail when swung from the collapsed position to the erect position and reversely.

More particularly, one of the features of this invention resides in providing a collapsible or folding chair of the type aforementioned in which the upper reinforcing side or seat-supporting rails project inwardly of the uppermost portion of the respective front and rear legs so as to expose for attachment by way of suitable pivots to the uprights of the associated unitary armrest and backrest supporting structures, the adjacent outer uppermost portion or region of each leg, the side or seat rails having a configuration and an extent so as to present contact or abutment surfaces outermost to each respective armrest and backrest structure above the location of the pivots to thereby limit swinging movement of same inwardly and so fix or establish the final erect or upright disposition of the armrest and backrest structure in chair-defining relation.

Still more particularly, it is a feature of this invention to provide each respective unitary armrest and backrest structures with a reinforcing bar extending front to rear of the respective uprights and projecting inwardly thereof, the configuration and location of such reinforcing bar being selected such that it moves into overlying abutment with the uppermost portion of the adjacent seat-supporting rail as the outermost surface of the seat-supporting rail contacts the uprights.

By attaching the seat-supporting rails directly to the pairs of legs at each side, the central or uninterrupted portions thereof are fully exposed and available to carry the flexible seat element, by simply passing the edge portions of the flexible seat element over, down and around the outermost surfaces of the seat-supporting rails so that the edge portions can be secured either directly to the rails by suitable fasteners or attached thereto or suspended therefrom in any other acceptable manner.

It will be appreciated that additional gripping support for the edge portions of the flexible seat element is provided by the separable reinforcing bars carried by the armrest and backrest structures in chair-defining relation in that upon movement of the reinforcing bars into overlying abutment with the seat rails, the edge portions overlying the central portions of the seat rails will be engaged and tightly gripped or clamped along the opposed surfaces which additionally anchors the flexible seat element against displacement.

It is another feature of the invention to provide seat rails having a somewhat elongated configuration in cross-section, the longer dimension in cross-section being arranged to extend generally parallel to the longitudinal axes of the legs to which the seat rails are attached. Thus disposed, the seat element presents downwardly and inwardly inclined supporting surfaces to the fabric or material of the seat element so that the central portion thereof can be disposed downwardly between or below the seat rails thereby lowering the centre of gravity when the chain is in use and increasing the stability of same.

Still another feature resides in applying a contour or shaping to the contact or abutment surfaces of the seat-supporting rails such that they generally match the outline of the recesses presented at the junction of the uprights and reinforcing bars of the armrest and backrest structures at each corner of the chair so as to tightly register therewithin in chair-defining relation, an arrangement which promotes the overall rigidity and stability of the erect framework.

These and other objects and features will become apparent upon reading the following description together with the illustrations of a collapsible or folding chair embodying the invention appearing in the accompanying drawings.

Figure 1:
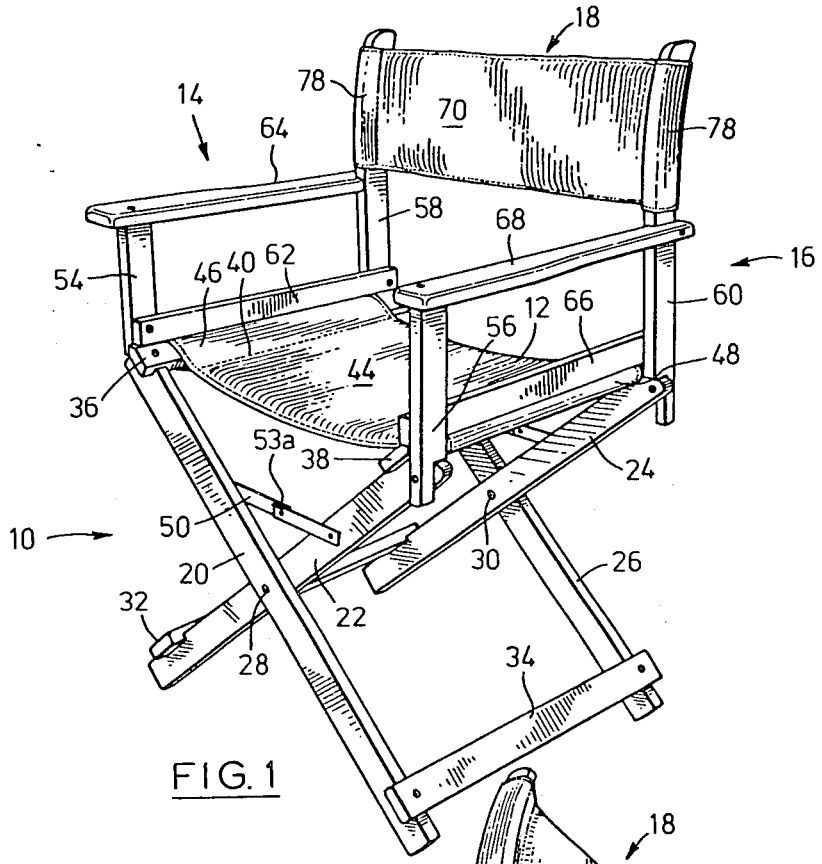
FIG. 1 is a perspective view of such collapsible or folding chair taken from a point upwardly and to the right of the front elevation thereof.

The collapsible or folding chair illustrated by the several drawings includes a collapsible or folding lower support or leg structure 10, a foldable seat element 12, opposed swingable unitary armrest and backrest structures 14 and 16, and a foldable backrest element 18.

The lower support or leg structure 10 illustrated in FIGS. 1 to 4, particularly, comprises a front pair of crossed legs 20, 22, a rear pair of crossed legs 24, 26 with each pair interconnected by a suitable central pivot member 28, 30 respectively which are in front to rear axial alignment.

In the the preferred embodiment illustrated, the rear pair of pivotally interconnected crossed legs 24, 26 are a mirror-image of the front pair of pivotally interconnected crossed legs 20, 22.

The lower extremities of each of front legs 20, 22 and rear legs 24, 26 are rigidly interconnected by reinforcing transversely extending bars 32, 34 respectively, each bar 32, 34 preferably located outwardly of and upwardly from the lowermost end of each leg.

The upper extremities of front legs 20, 22 and rear legs 24, 26 are likewise rigidly interconnected by transversely extending reinforcing side or seat-supporting rails 36, 38 respectively projecting inwardly of the uppermost ends of each leg and exposing the adjacent portions 20*a*, 22*a*, 24*a*, 26*a* for attachment to the armrest and backrest structures 14, 16 as well be described.

Extending between and supported by the central uninterrupted portions of side or seat-supporting rails 36, 38 is the foldable seat element 12. In the preferred embodiment seat element 12 is derived from strong flexible sheet material, e.g. canvas or any suitable woven or extruded substitute. Seat element 12 has an extent such that when suitably secured to side rails 36 and 38, with crossed legs 20, 22 and 24, 26 swung to a position of selected maximum separation, seat element 12 is suspended from side rails 36, 38 in sufficient tension so as to give adequate support to the weight of the person using same.

Seat element 12 according to the embodiment illustrated takes the form of a canvas envelope, or double layer of sheet material securely stitched as at 40, 42 to provide a large central section 44 and elongated tubular side edge portions 46, 48 with padding or a sheet of suitable foamed compressible material disposed between the canvas layers of central section 40 and secured therewithin by stitching to provide greater comfort.

The tubular edge portions 46, 48 have requisite dimensions so as to surround the central portions of the respective seat rails 36, 38 in a relatively loose manner to permit ready assembly and also to accommodate the suspension of central section 44 of seat element 12 from the seat rails 36, 38 and to provide the desired tensioning in the seat element.

The separation of seat-supporting rails 36, 38 is limited by metal linkages 50, 52 extending between each of pair of legs 20, 22 and 24, 26 respectively, each linkage 50, 52 including suitable integral stops or flanges 53*a*, 53*b* respectively so as to releasably lock same at a maximum extension of 180 degrees and not therebeyond, thereby establishing the ultimate separation between the respective legs as well as stabilizing the framework in chair-defining relation.

The swingable armrest and backrest structures 14, 16 respectively include the following: front upright or upstanding members 54, 56 respectively, rear upright or upstanding members 58, 60 respectively, upright members 54, 58 being rigidly interconnected by a lower transversely extending reinforcing bar 62 and an upper armrest member 64, with upright members 58, 60 likewise being rigidly interconnected by a lower transversely extending reinforcing bar 66 and an upper armrest member 68.

Foldable backrest element 18 in the embodiment illustrated takes the form of a canvas envelope corresponding in structure to that of foldable seat element 12, the large layered central portion 70 enclosing padding or foamed sheeting to provide greater comfort.

Figure 2:
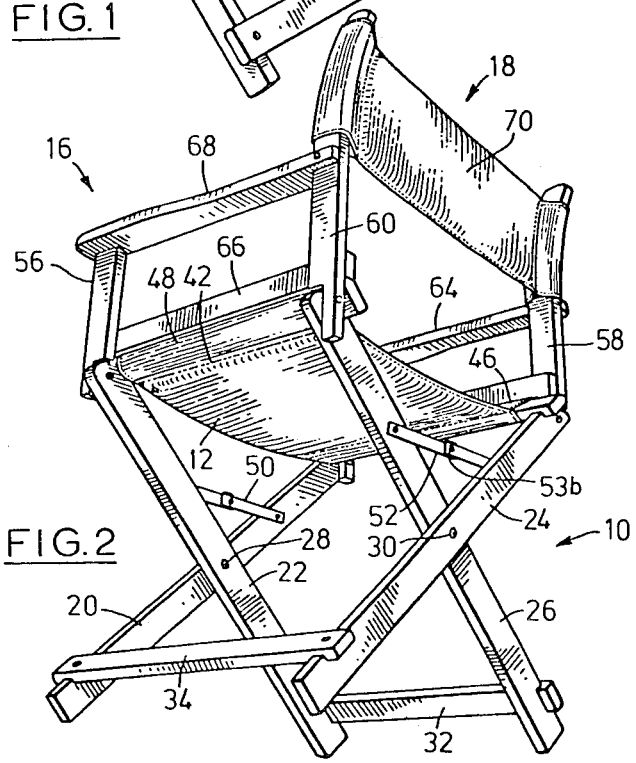
FIG. 2 is a perspective view taken from a point downwardly and to the left of the rear elevation thereof.
Figure 4:
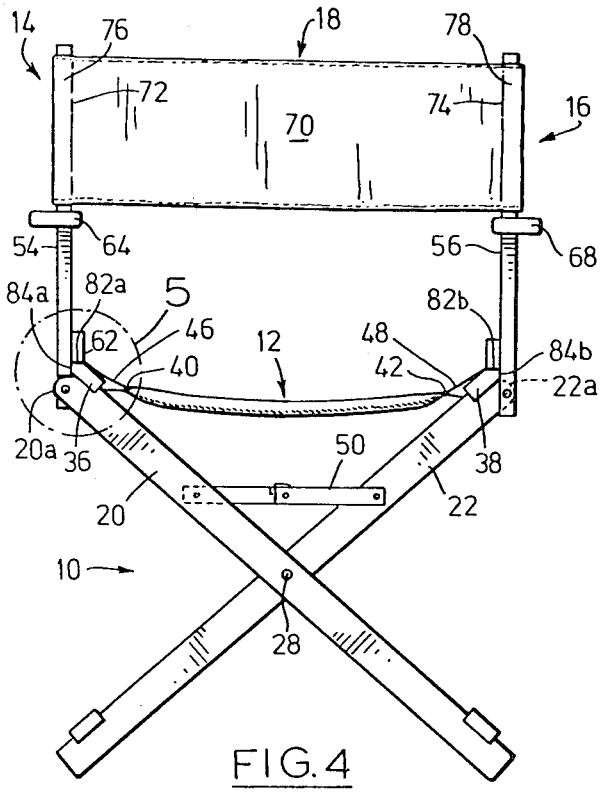
FIG. 4 is a front elevational view of the chair of FIGS. 1 and 2.

The canvas envelope of backrest element 18 likewise is uitably stitched as at 72, 74 to present elongated tubular edge portions 76, 78 which are adapted to receive the uppermost portions or extensions of rear upright or upstanding members 58, 60. By appropriate dimensioning, the backrest element 18 is suitably tensioned between the uppermost extensions of rear upstanding members 58, 60 so as to urge the opposed armrest and backrest structures 14, 16 into abutment against the seat rails 36, 38 when disposed in chair-defining relation as best illustrated in FIGS. 1, 2 and 4 also provide a firm support for the back of the user.

Figure 3:
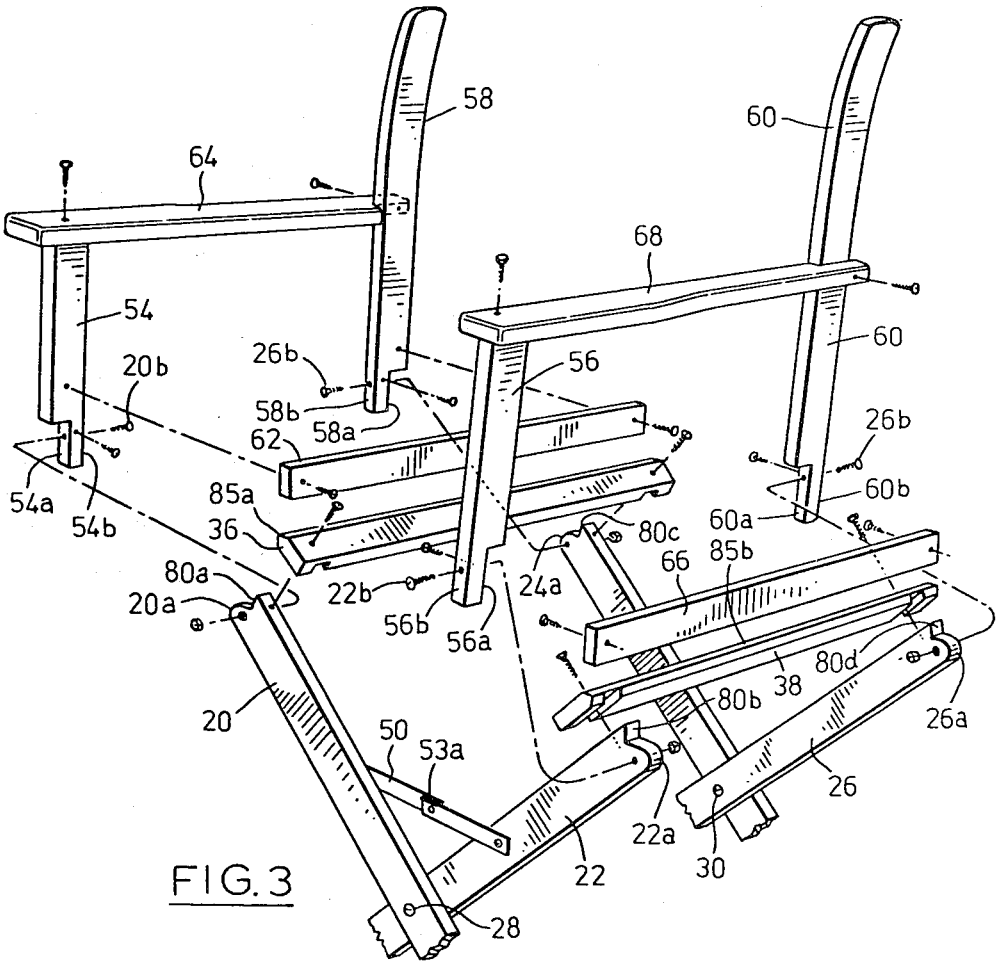
FIG. 3 is a perspective view partly exploded of the framework of the chair of FIGS. 1 and 2 with certain components broken away so as to illustrate the relationships and the manner of connection one to the other.

Each of upright or upstanding members 54, 56, 58, and 60 respectively is provided with a recess or notch lowermost as at 54*a*, 56*a*, 58*a* and 60*a* respectively, as best illustrated in FIG. 3, to receive the outer uppermost portions 20*a*, 22*a*, 24*a* and 26*a* of legs 20, 22, 24 and 26 respectively, for connection to the adjacent downward extensions 54*b*, 56*b*, 58*b* and 60*b* of upright members 54, 56, 58 and 60 by suitable pivots 20*b*, 22*b*, 24*b*, and 26*b*.

It is emphasized that in the case of the paired legs 20, 24 and paired legs 22, 26, the first pair are more widely spaced apart than the second pair.

Accordingly, having regard to the upright or upstanding members 54, 58, the downward extensions 54*b* and 58*b* are disposed within or flanked by the uppermost leg portions 20*a*, 24*a* whereas in the case of downward extensions 56*b*, 60*b* of upstanding members 56 and 60 respectively, those are without or flank the respective uppermost leg portions 22*a*, 26*a*. Such an arrangement, according to the preferred embodiment of the invention, brings front upstanding members 54, 56 and rear upstanding members 58, 60 into alignment when viewed in side elevation.

The curvate configurations applied to uppermost leg portions 20*a*, 22*a*, 24*a* and 26*a* are centered generally upon respective axes of pivots 20*b*, 22*b*, 24*b*, 26*b* and terminate inwardly in upwardly extending angled flat portions 80*a*, 80*b*, 80*c* and 80*d* as best illustrated in FIG. 3.

Figure 6:
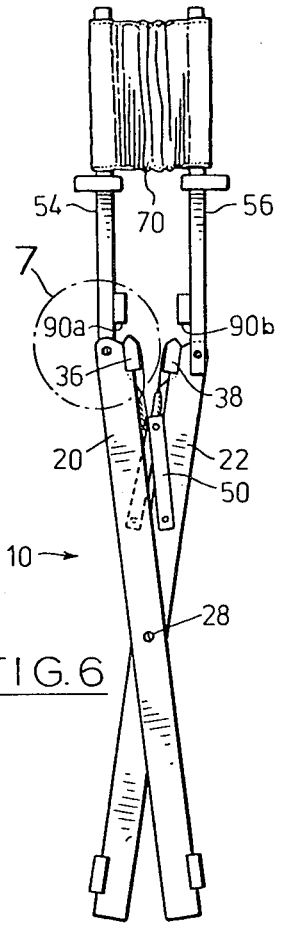
FIG. 6 is a front elevational view of the chair of FIG. 4 in the collapsed or folded condition.

The extent of the applied curvate configuration is such that it provides sufficient clearance when the respective lower support leg structure 10 ffolding seat element 12 arm rest and backrest structures 14 and 16 and folding back rest element 18 are swung from the fully erect position of FIG. 4 to the fully extended folded or collapsed position of FIG. 6 and reversely.

Seat-supporting rails 36, 38 preferably have a shaping in cross-section that is elongated, with the longer dimension arranged to extend generally parallel to the longitudinal axis of the respective legs, as best illustrated in FIGS. 4 to 7 inclusive.

Each seat-supporting rail 36, 38 is bounded by angled flat surfaces 82*a*, 82*b* respectively and 84*a*, 84*b* respectively and by generally opposed parallel surfaces 86*a*, 86*b* and 88*a*, 88*b* respectively.

Edges 85*a* and 85*b* of seat-supporting rail 36 and seat-supporting rail 38 are adapted to contact or abut the adjacent overlying surfaces 90*a* and 90*b* respectively of reinforcing bars 32, 34 with surfaces 84*a* and 84*b* in the preferred embodiment merging with the angled flat portions 80*a*, 80*b*, 80*c* and 80*d* respectively of supporting legs 20, 22, 24 and 26.

The latter mentioned angled flat portions 80*a*, 80*b*, 80*c* and 80*d* together with surfaces 84*a*, 84*b* are adapted to contact the inner surfaces of uprights 54, 56, 58 and 60 below uppermost edges 85*a*, 85*b* as indicated generally at 92 and 94 respectively in FIGS. 4 through 7 inclusive, when the framework is swung into chair-defining relation, and particularly as illustrated in both FIGS. 4 and 5.

By so locating seat-supporting rails 36, 38 upon the respective legs to extend above and inwardly of the pivots joining the legs to the armrest and backrest structures 14 and 16 and by mounting the reinforcing bars 62, 66 in spaced relation above the pivots to project inwardly of uprights 54, 56, 58 and 60 respectively and by so shaping seat rails 36, 38 appropriately to present edges 85*a*, 85*b* uppermost, appropriate gripping or clamping and supporting abutment is achieved upon registration of seat-supporting rails 36, 38 fully within the recesses defined at the junction of uprights 54, 56, 58 and 60 and interconnecting reinforcing bars 62, 66.

This arrangement establishes not only rigid limit positions for the armrest and backrest structures 14 and 16 at each corner of the chair as they are swung into upright chair-defining relation but also by establishing overlying contact or abutment of lower surfaces 90*a* and 90*b* of reinforcing bars 62, 66 with the upper surfaces 82*a*, 82*b* of seat-supporting rails 36, 38, an additional clamping or gripping force is exerted upon the tubular side edge portions 46, 48 of seat element 12 in these regions extending between the uprights.

This clamping or gripping engagement not only additionally anchors the edges of seat element 12 but tends to unify the overall structure front to rear, thereby promoting rigidity and stability of the chair.

As earlier mentioned, the foldable backrest element 18 is appropriately dimensioned so that there is a slight tension exerted between uprights 56, 58 in chair-defining relation particularly when occupied, urging the opposed armrest and backrest structures 14 and 16 inwardly against seat rails 36, 38 thereby positively exerting the clamping or gripping forces described and so further reinforcing the framework.

Figure 5:
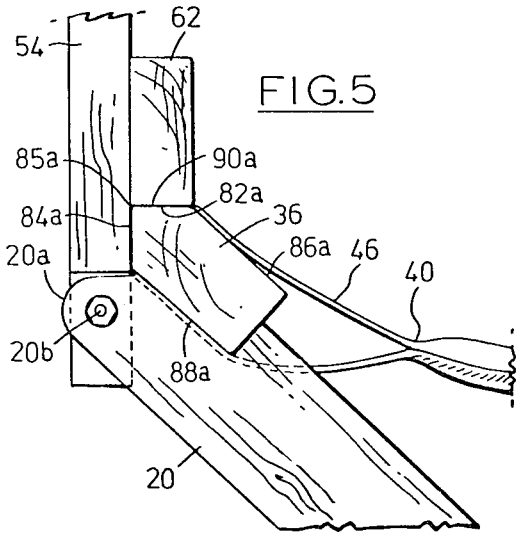
FIG. 5 is an enlarged view of the interconnection between the leg and unitary armrest and backrest structure of the chair as viewed in FIG. 4 as indicated at 5 in FIG. 4.
Figure 7:
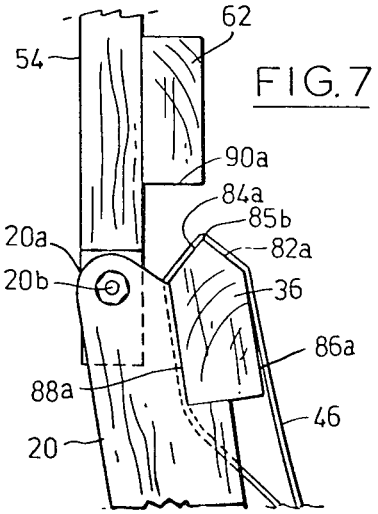
FIG. 7 is an enlarged view of the interconnection between the leg and unitary armrest and backrest structure of the collapsed chair of FIG. 6 as indicated at 7 in FIG. 6.

It will be apparentt from FIGS. 5 and 6 particularly and also from FIGS. 1 and 2 that the surfaces 86*a*, 86*b* and 88*a*, 88*b* of seat-supporting rails 36, 38 respectively slope inwardly and downwardly within the framework in chair-defining relation.

With that disposition the loops 46, 48 of seat element 12 follow the sloping contours of seat rails 36, 38 so as to dispose or present the central section 40 well below and inwardly of abutting gripping surfaces 82*a*, 82*b*, which arrangement has the effect of not only uniformly contouring the seat element 12 but lowering the center of gravity of the chair when occupied therefore tending to further increase its stability.

All principal components of the collapsible chair are preferably fashioned from pieces of hardwood, preferably birch or maple. In the preferred embodiment all wooden frame members have the same thickness of the order of $\frac{3}{4}''$ with the widths varying from $1\frac{1}{4}''$ to $1\frac{5}{8}''$. Such material is readily available in lengths as a standard or stock item.

The manner for attaching the frame members to one another is conventional.

In the case of the supporting leg structure 10, the reinforcing transversely extending bars 32, 34 and the reinforcing transversely extending side or seat-supporting rails 36, 38 are appropriately grooved and closely fitted to the leg thicknesses, the joints or connections being established by optionally gluing same together and then securing the joints by appropriate screw threaded fasteners of requisite strength.

All other joints involve the optional gluing of abutting surfaces together and using appropriate screw threaded fasteners of requisite strength to secure the attachments.

In the case of anchoring the metal pivots 20*b*, 22*b*, 24*b*, 26*b* in downward extensions 54*b*, 56*b*, 58*b* and 60*b* of the uprights fashioned from hardwood it was found that the connection could be made more secure and durable by introducing threaded fasteners 98*a*, 98*b*, 98*c* and 98*d* at right angles to the axis of the respective pivots at points slightly thereabove and substantially centered as indicated in FIG. 3 of the drawings.

Further, according to the preferred embodiment each leg 20, 22, 24 and 26 has the identical pattern also the front upright members 54, 56 and reinforcing transversely extending bars 62 and 66 are likewise derived from identical patterns.

In the case of lower reinforcing transversely extending bars 32, 34 and the seat-supporting rails 36, 38 one of each is longer than the other so as to match and bridge the separation between the outer pair of legs 20, 26 and inner pair of legs 22, 24 with the upper armrest members 64 and 68 having opposite symmetry by reason of the applied contour or shape given to those members for the sake of appearance.

In the case of the illustrated embodiment the rear upright members 58, 60 have a slight curvature in the upper portions thereof and, while each can be derived from an identical piece, a separate pattern is required for the final shape.

Whereas hardwood pieces for the principal frame members are preferred, equivalent metal components can be utilized to construct the framework of the collapsible chair in the manner particularly detailed in FIG. 3 which emphasizes the simplicity of the principal components and their essential relationships so as to achieve tthe novel and unobvious advantages outlined herein.

Finally it will be understood that variations or alternatives may be introduced or included in the collapsible or foldable chair structure described and illustrated by those persons skilled in this field without departing from the spirit or scope of the invention defined by the appended claims.

What I claim is:

1. In a collapsible chair including a front pair and rear pair of crossed, pivotally interconnected legs having a common pivot axis extending from front to rear, a seat-supporting rail extending between said pairs of legs front to rear at each side with each such seat-supporting rails secured to the uppermost portion of each leg and inwardly thereof and in substantially parallel relation to one another for swinging movement with said legs about said pivot axis from a collapsed position in which said seat-supporting rails are in substantial side-by-side relation to an erect position in which said seat-supporting rails are spaced apart in chair-defining relation, and reversely, a unitary armrest and backrest supporting structure extending between said pairs of legs front to rear at each side, pivot means pivotally securing each said unitary supporting structure to the uppermost portion of each respective leg only, on an axis located outwardly of and below the uppermost extent of the adjacent inner seat-supporting rails for swinging movement upon said legs from said collapsed position wherein each said unitary supporting structure is separated from said adjacent inner seat-supporting rail to said erect position wherein each said unitary supporting structure is in substantial upstanding abutment therewith in chair-defining relation, and reversely, each said unitary supporting structure including a reinforcing member projecting inwardly thereof and therealong and so upwardly spaced from its said pivot axis as to move into and out of overlying engagement with the uppermost surface of said adjacent inner seat-supporting rail when swung from said collapsed position to said erect position and reversely.

2. A collapsible chair according to claim 1 in which the uppemost surface of each said seat-supporting rails is defined by the intersection of angled surfaces presented by each said seat-supporting rails, the outermost angled surfaces thereof below said intersection being adapted to abut said unitary armrest and backrest supporting structures respectively in chair-defining relation.

3. A collapsible chair according to claim 2 in which each of said seat-suporting rails inwardly of the uppermost surface of same present downwardly and inwardly inclined supporting surfaces and includes a flexible seat element having a central section and side edge portions extending therebetween, with said side edge portions so secured thereto as to follow the contour of said downwardly and inwardly inclined supporting surfaces theeof when swung into chair-defining relation to thereby support the central portion of said flexible seat element therebelow.

4. A collapsible chair according to claims 3, in which said side edge portions of said flexible seat element have a tubular configuration, the tubular side edge portions thereof enclosing the portion of said seat-supporting rails extending between said legs and following the contour of said downwardly and inwardly inclined supporting surfaces in chair-defining relation to thereby present the central portion of said flexible seat element therebelow.

5. A collapsible chair according to claims 1, 2, 3 or 4 in which each said unitary armrest and backrest supporting structures includes a front and rear upstanding armrest and backrest supporting members, each such front and rear upstanding supporting members terminating lowermost in a vertically extending recessed portion and receiving the uppermost portion of each respective leg therewithin and extending therebelow, with said pivot means pivotally securing each said unitary support structure to said uppermost portion of each respective leg only, being carried by said recessed portions of said front and rear upstanding support members respectively.

6. A collapsible chair according to claim 5 in which said vertically extending recessed portions of the front and rear upstanding members of one of said armrest and backrest structures are flanked by said uppermost leg portions to which they are pivotally secured and in which the vertically extending recessed portions of the front and rear upstanding members of the other of said armrest and backrest structures flank said uppermost leg portions to which they are pivotally secured.

7. A collapsible chair according to claims 5 in which each said rear upstanding support member terminates uppermost in a backrest supporting extension thereof and includes a flexible backrest element extending therebetween and so secured to said backrest supporting extensions as to urge same into substantial upstanding abutment with said seat-supporting rails in chair-defining relation.

* * * * *